US008974134B2

(12) United States Patent
Wilson et al.

(10) Patent No.: US 8,974,134 B2
(45) Date of Patent: Mar. 10, 2015

(54) PACKAGE FOR APPLYING A PERSONAL CARE PRODUCT

(75) Inventors: David Edward Wilson, Reisterstown, MD (US); Ellen Mary Loughren, Cockeysville, MD (US); Ian Andrew Carnduff, New York, NY (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/114,257

(22) Filed: May 24, 2011

(65) Prior Publication Data

US 2011/0280647 A1 Nov. 17, 2011

Related U.S. Application Data

(63) Continuation of application No. PCT/US2011/024719, filed on Feb. 14, 2011.

(60) Provisional application No. 61/304,424, filed on Feb. 13, 2010.

(51) Int. Cl.
*A47L 13/30* (2006.01)
*A45D 34/04* (2006.01)

(52) U.S. Cl.
CPC ..... *A45D 34/041* (2013.01)
USPC ..... 401/263; 401/37; 401/183; 401/261

(58) Field of Classification Search
USPC ..... 401/208, 218, 219, 220, 183–186, 6, 401/37, 261–266
See application file for complete search history.

(56) References Cited

U.S. PATENT DOCUMENTS

| | | | | |
|---|---|---|---|---|
| 3,048,880 | A | 8/1962 | Sloman | |
| 3,100,908 | A | 8/1963 | Engle | |
| 3,162,885 | A * | 12/1964 | Tanner | 401/131 |
| 3,268,943 | A | 8/1966 | Melnyck | |
| 3,702,739 | A | 11/1972 | Rentfrow | |
| 4,150,904 | A * | 4/1979 | Stewart | 401/186 |

(Continued)

FOREIGN PATENT DOCUMENTS

| | | |
|---|---|---|
| CH | 595888 | 2/1978 |
| DE | 3447845 | 7/1986 |

(Continued)

OTHER PUBLICATIONS

PCT International Search Report, Apr. 29, 2011, 66 pages.

*Primary Examiner* — David Walczak
(74) *Attorney, Agent, or Firm* — Carlos A. Garcia; Charles R. Ware; John G. Powell

(57) ABSTRACT

A package for applying a liquid personal care product. the package including a body for storing and dispensing a personal care product and an applicator with a skin-contacting portion for applying the personal care product to the skin of a user. The body of the package and the skin-contacting portion both have first and second cross-sectional shapes with major and minor dimensions aligned with one another. The major dimension being greater than the minor dimension. The skin contacting portion includes a patterned surface. The patterned surface produces a corresponding pattern on skin when the personal care product is applied thereto. The pattern may be configured to deliver a discontinuous film of product to the skin, resulting in natural looking coverage.

18 Claims, 9 Drawing Sheets

(56) References Cited

U.S. PATENT DOCUMENTS

| | | | | |
|---|---|---|---|---|
| 4,723,860 | A * | 2/1988 | Giblin et al. | 401/208 |
| 6,030,138 | A * | 2/2000 | Losier | 401/266 |
| 6,682,246 | B2 * | 1/2004 | Reggiani | 401/264 |
| 7,153,053 | B1 * | 12/2006 | Wiley | 401/219 |
| 7,153,653 | B2 | 12/2006 | Goggins | |
| 7,435,029 | B1 | 10/2008 | Marini | |
| 7,628,559 | B2 * | 12/2009 | Petit | 401/219 |
| 2006/0029455 | A1 | 2/2006 | Baines | |
| 2006/0233594 | A1 | 10/2006 | Erickson | |
| 2007/0086833 | A1 | 4/2007 | Gurrisi | |

FOREIGN PATENT DOCUMENTS

| | | | |
|---|---|---|---|
| DE | 3447856 | | 7/1986 |
| EP | 0079044 | | 5/1983 |
| EP | 0786214 | | 4/2002 |
| EP | 2223627 | | 9/2010 |
| ES | 2026370 | | 4/1992 |
| FR | 1164203 | | 10/1958 |
| FR | 2596674 | | 10/1987 |
| FR | 2640414 | | 1/1994 |
| FR | 2914625 | | 9/2011 |
| GB | 191004224 | | 2/2010 |
| JP | S60-75358 | A | 4/1985 |
| JP | 3044252 | U | 10/1997 |
| JP | 2002-159334 | A | 6/2002 |
| JP | 2003-265228 | A | 9/2003 |
| JP | 2005-29512 | A | 2/2005 |
| WO | WO9204842 | | 4/1992 |
| WO | WO 2004/018012 | A2 | 3/2004 |

* cited by examiner

PACKAGE FOR APPLYING A PERSONAL CARE PRODUCT

CROSS-REFERENCE TO RELATED APPLICATIONS

This application is a continuation of PCT Application No. PCT/US11/24719, filed Feb. 14, 2011, which claims the benefit of U.S. Provisional Application No. 61/304,424, filed Feb. 13, 2010.

FIELD OF THE INVENTION

The present invention is directed to an improved package for applying a liquid personal care product to the skin of a user.

BACKGROUND OF THE INVENTION

Liquid personal care products are available in a wide variety of packages, including bottles, jars, tubes, and cans. Few liquid personal care products on the market have built-in applicators wherein the product flows through the applicator. Some products on the market, such as certain deodorants, employ a roller-ball applicator technique to deliver product. However, other personal care products such as cosmetics foundations and lotions are traditionally dispensed out of a container into the hand or onto a sponge, and then applied to the skin. This application method however can be unsanitary, wasteful, and messy, and may lead to undesirable post-application hand washing.

Conventional applicators are typically not suitable for desirably applying cosmetic foundations or lotions to the entire face. For example, at least some conventional applicators are ergonomically designed to apply product onto larger areas of the face such as the cheeks and forehead, but not onto smaller skin areas such as the area between the lips and nose. But ergonomic packages may not provide intuitive applicator positioning commonly associated with cylindrical containers and/or applicators. On the other hand, cylinder-shaped applicators may not provide a suitable means to apply product to the smaller areas of the face.

Accordingly, it would be desirable to provide an intuitive package with skin-friendly dispensing that can apply a suitable amount of product directly onto the skin. It would also be desirable to configure such a package to better fit into a user's hand. It would further be desirable to provide an applicator that delivers a suitable amount of product to the skin with each movement of the applicator.

SUMMARY OF THE INVENTION

In order to provide a solution to the aforementioned problems, a package for applying a personal care product to the skin of a user is disclosed herein. The package comprises a body for storing and dispensing the personal care product. The body has a first cross-sectional shape and is graspable by the user's hand. The package also comprises an applicator joined to the body. The applicator includes a cylinder-shaped skin-contacting portion. The skin-contacting portion has a second cross-sectional shape and a surface pattern. Each of the first cross-sectional shape and the second cross-sectional shape has a major dimension oriented along a first axis and a minor dimension oriented along a second axis. The major dimensions are greater than the minor dimensions.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
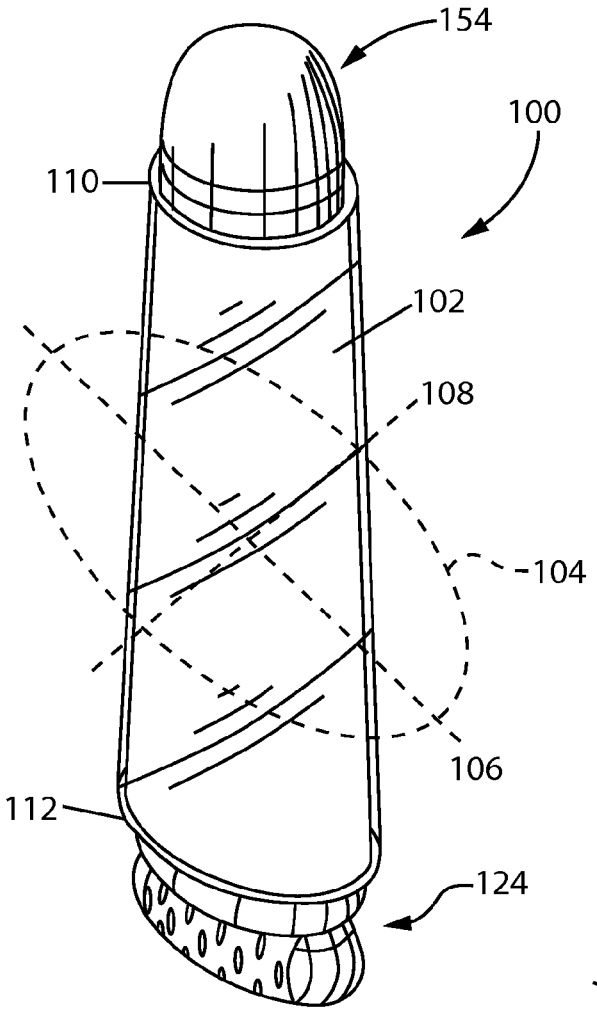
FIG. 1 is a perspective view of an embodiment of a package.

The improved package disclosed herein may be understood more readily by reference to the following detailed description of illustrative and preferred embodiments. It is to be understood that the scope of the claims is not limited to the specific ingredients, methods, conditions, devices, or parameters described herein, and that the terminology used herein is not intended to be limiting of the claimed invention. Also, as used in the specification, including the appended claims, the singular forms "a," "an," and "the" include the plural, and reference to a particular numerical value includes at least that particular value, unless the context clearly dictates otherwise.

All percentages and ratios used herein are by weight of the total composition, and all measurements made are at 25° C., unless otherwise designated.

Packages suitable for use herein include a body portion with personal care product disposed therein. In certain embodiments, the personal care product is in the form a liquid or liquid-like substance. Flexible, resilient packages are known in the art and are typically deformable by applying pressure to the body of the package (e.g., by squeezing), which urges a volume of personal care product to an applicator or skin-contacting portion. In certain embodiments, the package may include a one-way valve to enable a user to control the flow of the personal care product. It is to be appreciated that the packages herein may include additional or alternative mechanisms for dispensing the personal care product. Nonlimiting examples of known dispensing mechanisms include electronic pumps; manual pumps; screw-driven pistons or rods; pressurized gasses such aerosols and the like; and trigger pumps.

In certain embodiments, the package may include an applicator for receiving personal care product dispensed from the body of the package and applying it to the skin of a user. All or a portion of the applicator may be fixed or movable (e.g., pivotable, rotatable, detachable, and/or reattachable). The applicator includes a skin-contacting portion for desirably transferring the personal care product to the skin of a user. The skin-contacting portion may be fixed or movable depending on the desired use. The skin-contacting portion is configured to apply the personal care product onto the skin in a desirable manner (e.g., evenly, smoothly, and/or natural looking). In an exemplary embodiment, the skin-contacting portion of the applicator may include a roller, which applies the personal care product while rotating about an axis. In this example, the skin-contacting portion receives the personal care product on its surface (e.g., passively via a discrete reservoir which is positioned in close proximity to the roller such that the personal care composition comes into contact with the surface of the roller as the roller rotates; through apertures in the surface of the roller fed by a channel in liquid communication with the body; and/or by actively urging the personal care composition directly onto the surface of the roller from the body) and, by rotation, deposits the personal care product onto the skin. In another exemplary embodiment, the applicator may include a dosing system wherein the personal care product is dosed through the center of a fixed skin-contacting portion and exits apertures (whether through a porous foam or sponge skin-contacting portion, or via a solid skin-contacting portion with holes fed through an axle).

The skin-contacting portion may includes a surface with a pattern thereon. The pattern may be formed by one or more of the same or different surface features. The surface features may be the same or different size, type (e.g., protrusion versus recess versus aperture), or shape (e.g., elliptical, circular, diamond, square). The surface features may be selected to configured to facilitate the transfer and/or application of the personal care product onto the skin of a user. Particularly suitable examples of surface features for use herein are described in more detail below.

The package may be configured for dual-ended or single-ended dispensing. Dual-ended dispensing applicators may be suitable for circumstances in which a small skin-contacting portion on one end and a larger skin-contacting portion on the other end is desired. Dual-ended dispens, it may be desirable to provide packages that include two or more personal-care products (e.g., a cosmetic primer and a foundation or a skin cleaner and a skin moisturizer) which can be dispensed through dual-ended dispensing applicators. In certain embodiments, the body of the package may include a first end and a second end opposed thereto. The first end may include an applicator and associated skin-contacting portion, while the opposing second end includes a blending tool joined thereto. The blending tool may be used to blend, distribute, or spread the personal care product over the skin.

FIGS. 1-4 show an exemplary embodiment of a package 100 suitable for use herein. As shown in FIG. 1, the package 100 includes a body 102 for receiving, storing and/or dispensing a personal care product 180 (e.g., skin care composition, cosmetic composition such as primer or foundation, and/or a combination of these). The body 102 of the package 100 includes a reservoir or similar storage space storing the personal care product. The body 102 of the package 100 is configured to facilitate grasping with a user's hand, for example, by having an ergonomic shape. The body 102 of the package 100 has a cross-sectional shape 104 defined at least in part by a major dimension 106 oriented along a first axis and a co-planar minor dimension 108 oriented along a second axis. While the shape of the cross-section of the body 102 shown in FIG. 1 appears substantially elliptical, it is to be understood that any suitable cross-section shape may be used as long as it is readily graspable by a user's hand. The body 102 of the package 100 may be formed from a suitable natural or synthetic material such as, for example, high density polyethylene ("HDPE"), low density polyethylene ("LDPE"), polyethylene terephthalate ("PET"), polypropylene ("PP"), polyvinyl chloride, polycarbonate, nylon, and fluorinated ethylene propylene. In certain embodiments, it may be desirable for form the body 102 from a flexible or pliable material. The body 102 may be made via a number of processes known in the art, such as blow molding, injection molding, and the like. The body 102 may be transparent, translucent, or opaque, as desired. Alternatively or additionally, the body 102 may be formed from a combination of such materials. For example, the body 102 may include a transparent portion to display a particular feature of the personal care product stored therein. In certain embodiments, it may be desirable to display a particular color, texture, and/or pattern of the personal care product 180 to provide a nonverbal cue to a potential consumer that the product has certain desirable features (e.g., white color to indicate sensitivity or swirl pattern to indicate multiple benefits).

The package 100 may include an applicator 124 and a blending tool 154. The applicator 124 may be attached to body 102 by any suitable means known in the art (e.g., with screw-threads, a snap-fit collar, or the like). In certain embodiments, the applicator 124 may be integral with body 102 (i.e., the applicator is assembled with the body during manufacturing and is not intended to be removed by a consumer during the product lifetime). In certain embodiments, the applicator 124 may be removably attached to body 102, (i.e., the applicator may or may not be assembled with the body during manufacturing and is intended to be removable by a consumer during the product lifetime without causing damage to the package which would impair its intended function), e.g., for cleaning or replacement with another applicator 124. In certain embodiments, the applicator 124 may be removed to enable user to dispense bulk product directly from body 102. The applicator 124 may be fixed or pivotable, relative to body 102. If in a fixed position, the package 100 desirably includes a suitable opening and closing mechanism (e.g., lever, switch, or valve) to start and stop product dispensing. If the position of the applicator 124 is not fixed, then the position of the applicator 124 may be changed to permit a user to start and stop the dispensing of product. For example, the applicator 124 may be configured to pivot in a plane parallel to the plane of the cross-section 104 such that when the applicator 124 is pivoted a particular amount (e.g., between 1 and 360 degrees or between 1 and 180 degrees), an opening is provided through which the personal care product 180 may be dispensed. When the applicator is pivoted back to the previous position and/or when the applicator is pivoted further (e.g., another 1 to 180 degrees) the opening is closed. Additionally or alternatively, the applicator may be configured to pivot to other positions to change the size and/or shape of the opening, thereby controlling the rate at which the personal care product is dispensed.

The package may include a one-way valve made from rubber or similar material, which is substantially impermeable to the personal care composition 180. The one-way valve may be positioned, for example, between the storage space in the body 102 and the skin contacting portion of the applicator 124. The one-way valve may be configured to be opened by squeezing the body 102 of the package 100, thereby permitting the personal care product 180 to flow through one-way valve, and closed when the squeezing pressure is removed.

Figure 2:
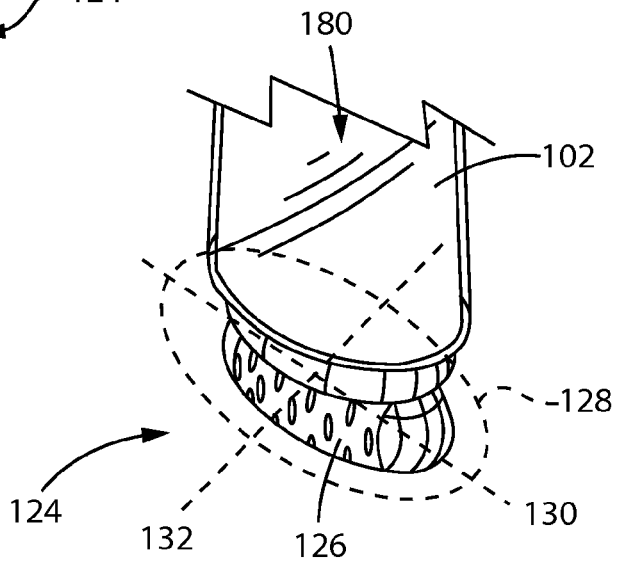
FIG. 2 is a perspective view of the bottom portion of the package shown in FIG. 1.

As shown in FIG. 2, the applicator 124 includes a skin-contacting portion 126 having a cross-sectional shape 128. The cross-sectional shape 128 of the skin-contacting portion is at least partially defined by a major dimension 130 oriented along a first axis and a co-planar minor dimension 132 oriented along a second axis. The applicator 124 may be configured to control the amount and spacing of applied product. For example, at least a portion of the skin-contacting portion 126 may be designed to fit between a user's nose and upper lip. As such, the minor dimension 132 of the skin-contacting portion 126 may be less than or equal to 1.9 cm or even 1.25 cm. Alternatively or additionally, the major dimension 130 of skin-contacting portion 126 may be less than or equal to 3.8 cm. The skin-contacting portion 126 may be in the shape of a cylinder, sphere, or other suitable shape, as desired. Suitable materials for the skin-contacting portion 126 include rubber, sponge, felt, cloth, wicking fibers, flocking, and combinations thereof. For example, the skin-contacting portion may be configured as a cylindrical roller formed from a soft, pliable material such as a commonly known thermoplastic elastomer ("TPE").

The package 100 may optionally include a blending tool 154 for manipulating the personal care composition after it has been applied to the skin (e.g., smoothing, spreading, and/or blending the personal care composition with the same or different personal care composition). The blending tool 154 may be attached to body 102 opposite the applicator 124 by any suitable means known in the art, such as with screw-threads, a snap-fit collar, or the like. The blending tool 154 may be removably attached to body 102 so that a user can remove the blending tool 154 to clean it or replace it with a new or different blending tool 154. In certain embodiments, the blending tool 154 may be removed to permit bulk dispensing of the personal care product from the package 100. The blending tool 154 may include a plurality of bristles, a paintbrush, a sponge, a loofah, a shower puff, a massager, or other like utensil suitable for blending, distributing, or spreading a liquid personal care product. For example, the blending tool 154 may be made from flexible and/or soft materials such as rubber, TPE, sponge, combinations thereof and the like. It may be desirable to form the blending tool from a material that is rinsable with a suitable solvent such as water, isopropyl alcohol, or acetone.

Figures 3A, 3B, 3C:
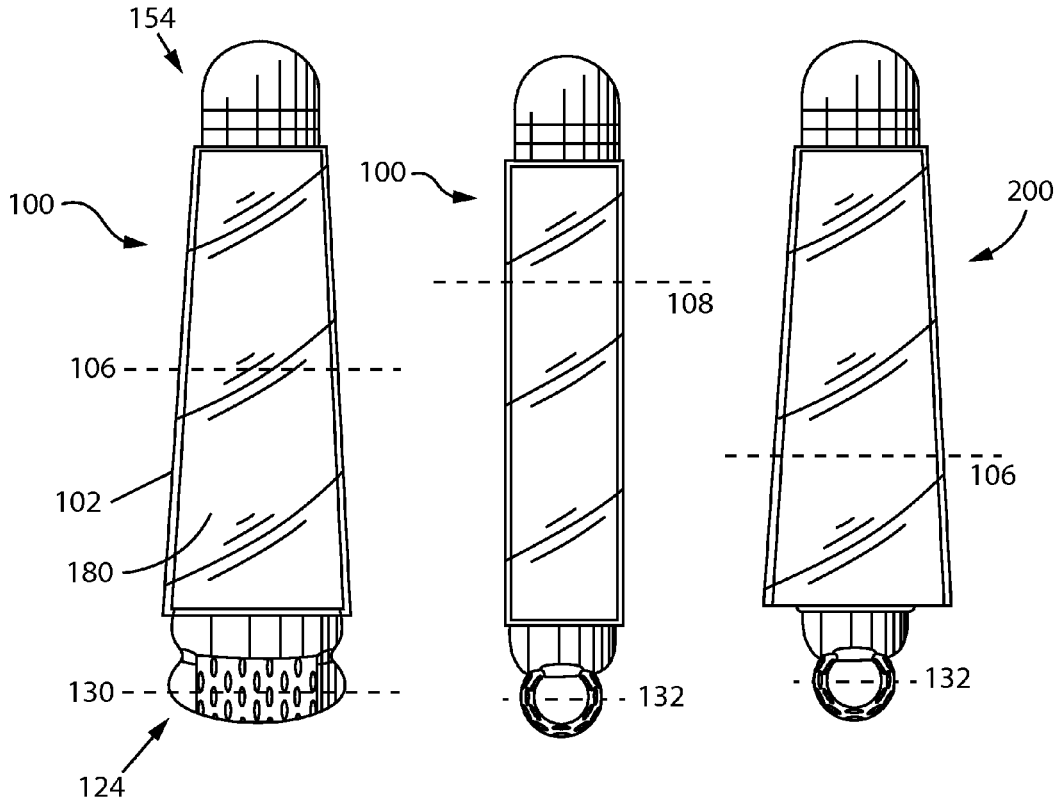
FIG. 3*a* is a front elevation view of the embodiment shown in FIG. 1.
FIG. 3*b* is a side elevation view of the embodiment shown in FIG. 1.
FIG. 3*c* is a front elevation view of an embodiment of a package.
Figure 4A:
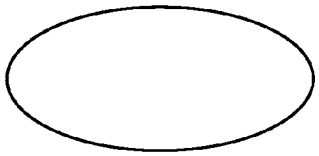
FIGS. 4*a-g* are examples of cross-sectional shapes.
Figure 4B:
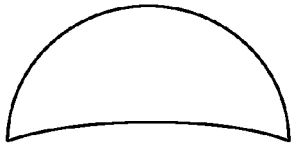
Figure 4C:
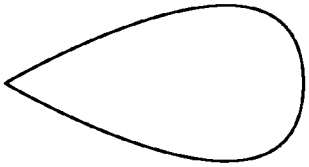
Figure 4D:
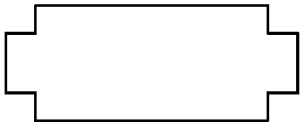
Figure 4E:
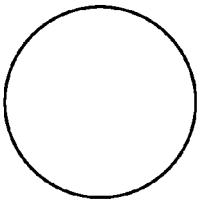
Figure 4F:
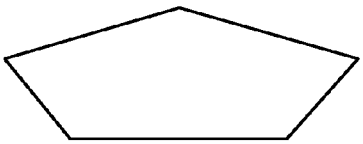
Figure 4G:
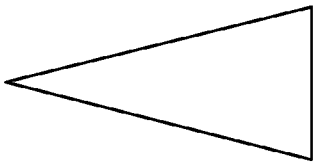

FIGS. 3*a* and 3*b* show the major dimension 106 and minor dimension 108 of the body 102 substantially aligned with the respective major dimension 130 and minor dimension 132 of the skin-contacting portion 126. But in certain embodiments, such as shown in FIG. 3*c*, the major dimension 106 of the body 102 substantially aligns with the minor dimension 132 of the skin-contacting portion 126. FIGS. 1 and 2 depict the cross-sectional shape 104 of the body 102 and the cross-sectional shape 128 of the skin-contacting portion 126 aligned vertically, but it is to be appreciated that the cross-sectional shapes 104 and 128 need not necessarily be in vertical alignment. For example, the skin-contacting portion 126 may be offset from the body 102 such that the skin-contacting portion 126 is not positioned vertically above the body 102, but rather extends outwardly from the side of the body 102. The skin-contacting portion 126 may be fixed at a particular angle relative to the longitudinal dimension of the body or it may be adjustable. The cross-sectional shapes 104 and/or 128 of the body 102 and/or the applicator 124, respectively, may take a variety of different shapes, as shown in FIGS. 4*a*-*g*. The shapes 104 and 128 may be substantially the same or different. For example, the cross-sectional shape 104 of the body 102 may resemble an oval shape while the cross-sectional shape 128 of skin-contacting portion may be more of a teardrop shape. In certain embodiments, the package 100 may include more than two distinct cross-sectional shapes.

Figure 5:
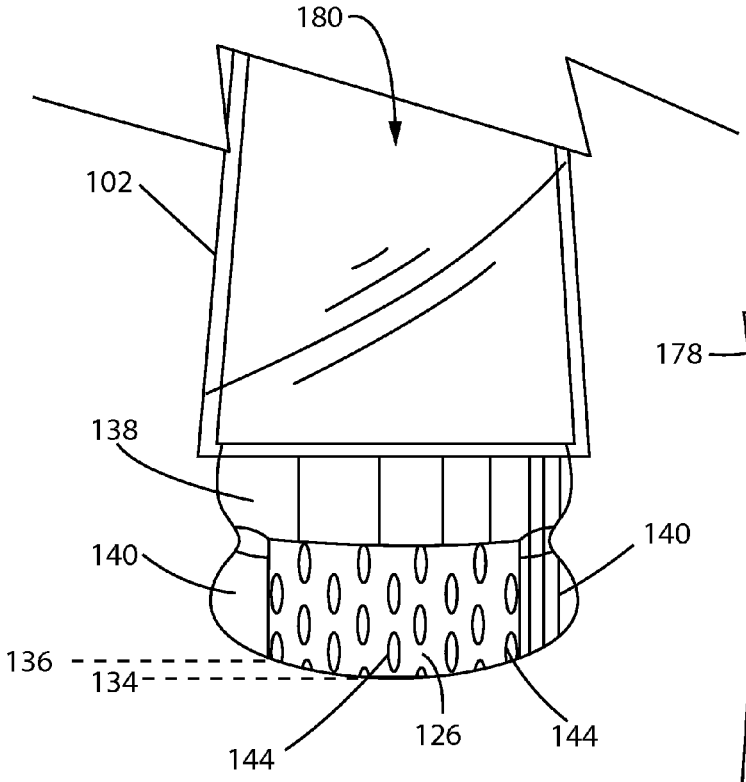
FIG. 5 is a front elevation view of the bottom portion of the package shown in FIG. 1.
Figure 8A:
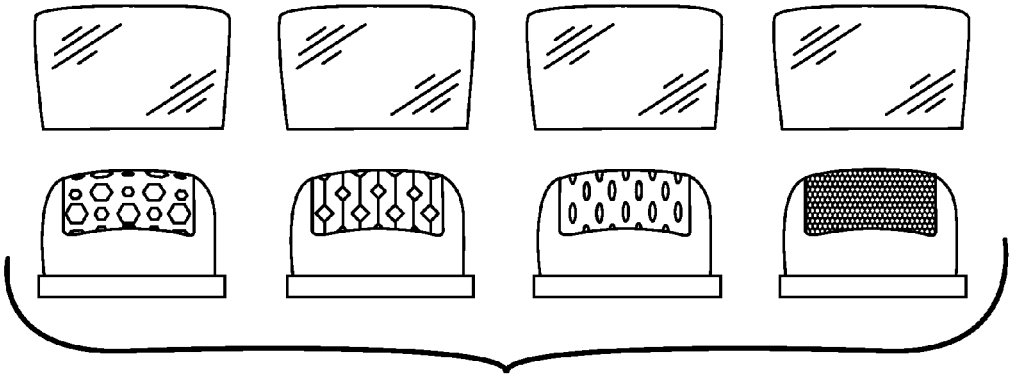
FIGS. 8*a-d* are examples of patterns and zones on the skin-contacting portion
Figure 8B:
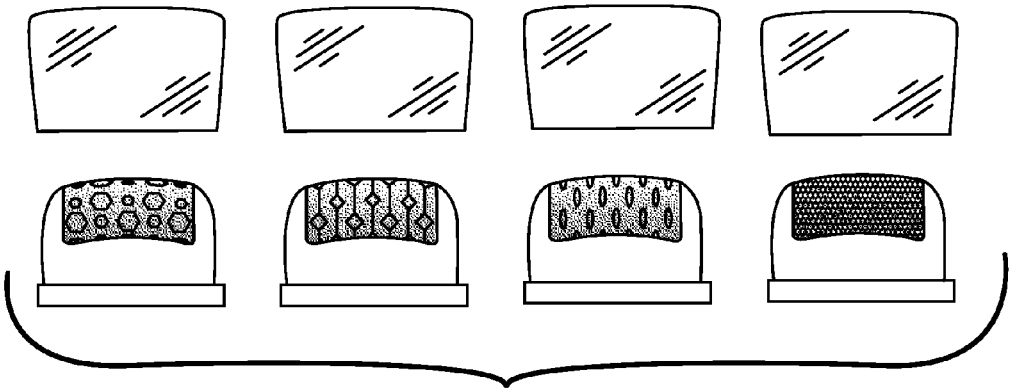
Figure 8C:
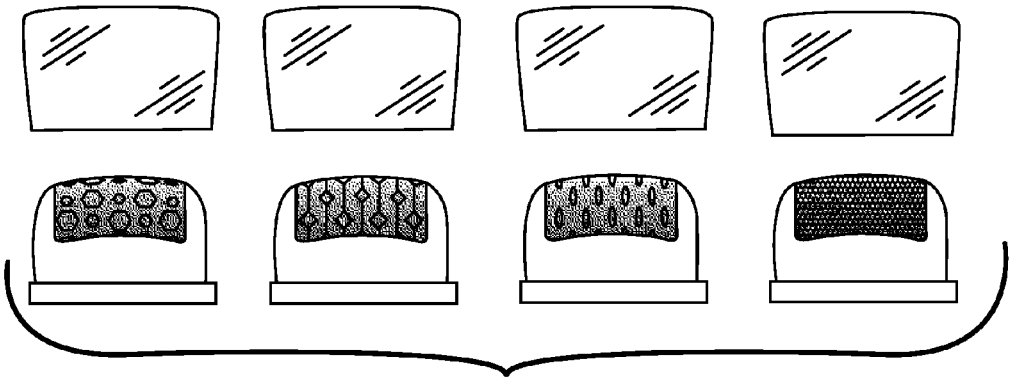
Figure 8D:
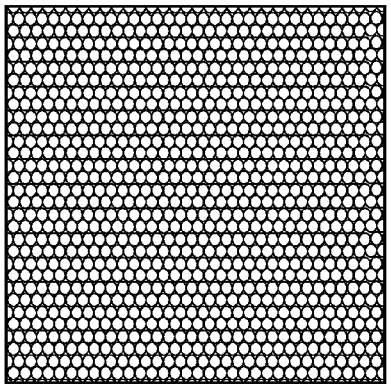
Figure 9A:
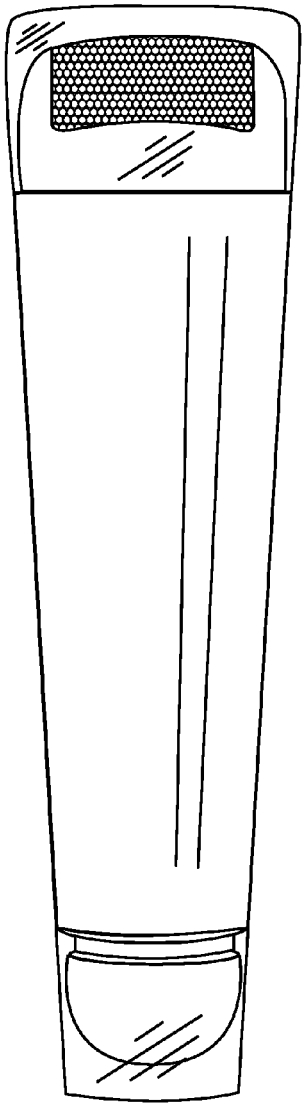
FIGS. 9*a-d* are further exemplary embodiments of a package for use herein.
Figure 9B:
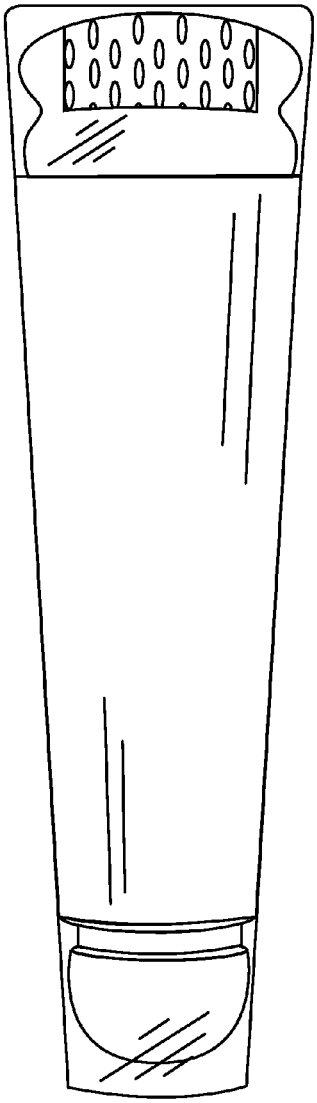
Figure 9C:
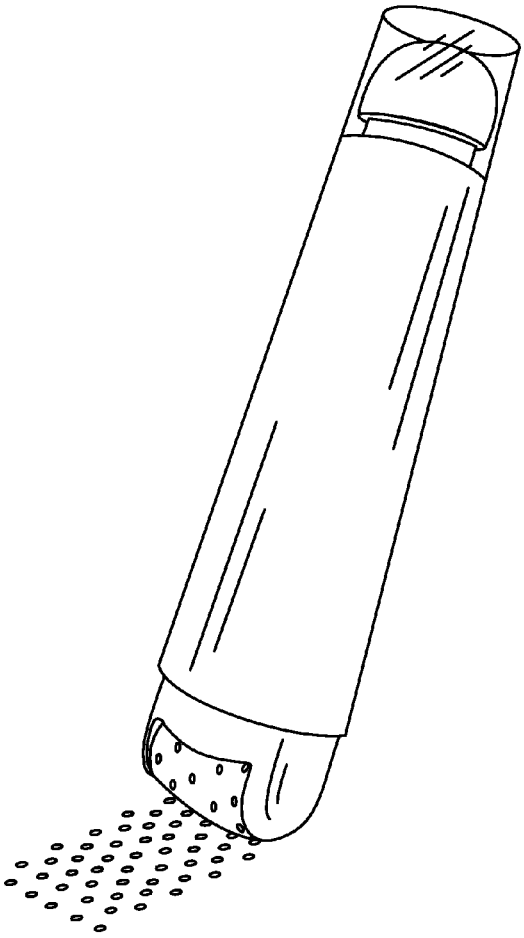
Figure 9D:
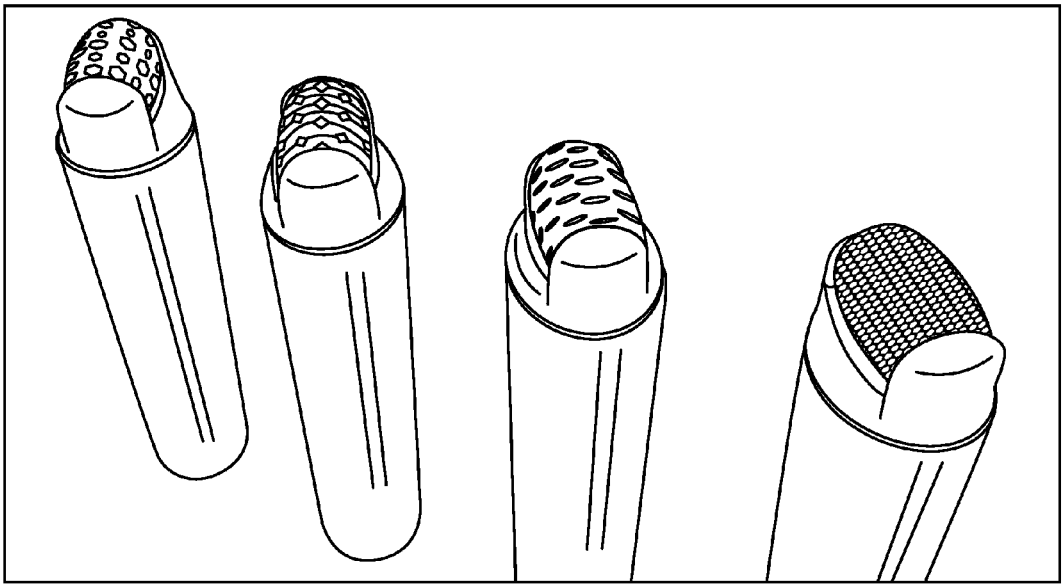

FIG. 5 shows an exemplary embodiment of an applicator 124. As shown, the skin-contacting portion 126 includes a first portion spaced away from the applicator base 138 by a first distance 134, and a second portion spaced away from the applicator base 138 by a second distance 136. It may be desirable to configure the first distance 134 to be greater than the second distance 136 or vice versa. In certain embodiments, the skin-contacting portion 126 may include three or more portions in various zones spaced away from the applicator base 138 by three different distances. The applicator 124 may include two or more arms 140, which extend downwardly from the body 102 of the package 100. The arms 140 may be configured to house skin-contacting portion 126 therebetween, and join the skin-contacting portion 126 to other portions of the package 100 (e.g., the body 102). The arms 140 may be rounded to form a divot as shown in FIG. 5, or may be flush with body 102, as shown in FIGS. 8*a*-8*c*. The skin-contacting portion 126 may be joined to one or both of the arms 140 via an axle, one or more pins, or any other known means suitable for joining a roller to two or more arms. The arms 140 and, optionally, the axle or other joining means, may include a channel or the like to place the body 102 in liquid communication with the skin-contacting portion 126.

The skin-contacting portion 126 includes a pattern 144 on its surface. The pattern 144 may be in the form of discontinuous dots, lines, and/or shapes; a continuous matrix; and/or a combination of these. The pattern on the skin-contacting portion 126 produces a corresponding pattern on skin when the personal care product 180 is applied thereto. The pattern 144 may be configured to deliver a discontinuous film of product to the skin, resulting in natural looking coverage. The pattern 144 may be formed by providing apertures that extend through the surface of the skin-contacting portion 126. Alternatively or additionally, the pattern 144 may be formed from recessed and/or raised portions disposed on the surface of the skin-contacting portion 126. In certain embodiments, the personal care product 180 disposed in the package 100 may flow through apertures of the pattern 144 onto the surface of the skin-contacting portion 126 during dispensing and application. In certain embodiments, (e.g., if the pattern 144 includes raised portions on the surface of the skin-contacting portion 126), the raised areas may be configured to pick up the personal care product 180 from, e.g., a trough or tray positioned in close proximity to the surface of the skin-contacting portion. In certain embodiments, the pattern 144 includes the raised portions and the personal care product 180 is applied only to the raised portions of the skin-contacting portion 125. In embodiments where the skin-contacting surface includes recessed portions disposed on its surface, the personal care product 180 may be deposited in the recessed portions and subsequently transferred to the skin of a user.

Exemplary surface patterns 144 for use on the skin-contacting portion 126 are illustrated in FIGS. 7A-R and 8*a*-*d*. The shapes of the surface features on the skin-contacting portion 126 that form the pattern 144 may be selected from any suitable shape known in the art. For example, the surface features may include donut-shaped dimples (i.e., recessed portions) which are shallow in the center and deeper around the outer circumference. Other exemplary shapes include star-shaped, square, etc. The skin-contacting portion 126 may configured to include two or more zones that include the same or different patterns and/or are formed from the same or different materials. Each zone may be further subdivided into two or more different sections based on the pattern and/or the material used to form the section. For example, the skin-contacting portion 126 may include a first zone formed from a relatively soft, pliable material with a discontinuous dot pattern on the surface, and a second zone formed from a relatively soft, absorptive material with no pattern on the surface. In another example, the entire skin-contacting portion 126 may be formed from the same material, but have a first zone with recessed and/or protruding surface features and a second zone with apertures. In still another example, the skin-contacting portion 126 may include a first zone with two differently shaped apertures spaced away from one another by a first distance, and a second zone with the same shaped apertures as the first zone but spaced apart by a second distance, which is greater than the first distance. In this example, the distance between two apertures is the shortest straight line distance between the centers of the two adjacent apertures.

Figure 6:
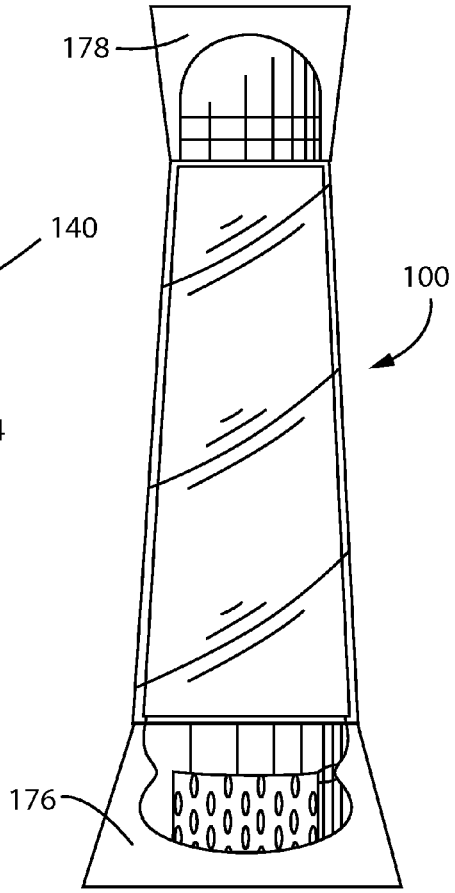
FIG. 6 is a front elevation view of an embodiment of a package.
Figure 7A:
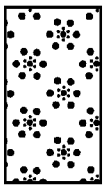
FIGS. 7A-R are examples of patterns suitable for the skin-contacting portion.
Figure 7B:
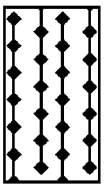
Figure 7C:
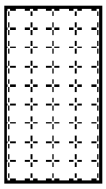
Figure 7D:
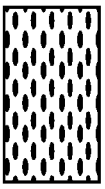
Figure 7E:
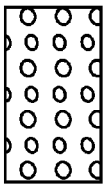
Figure 7F:
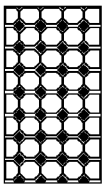
Figure 7G:
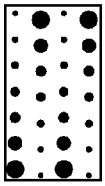
Figure 7H:
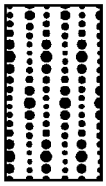
Figure 7I:
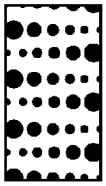
Figure 7J:
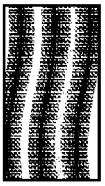
Figure 7K:
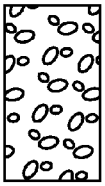
Figure 7L:
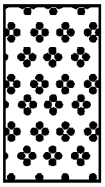
Figure 7M:
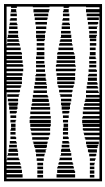
Figure 7N:
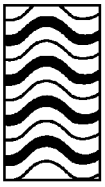
Figure 7O:
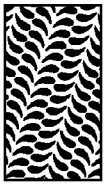
Figure 7P:
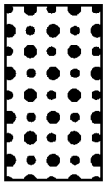
Figure 7Q:
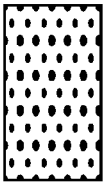
Figure 7R:
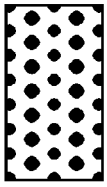

FIG. 6 shows an exemplary embodiment of a package 100 that includes one or more caps 176 and 178. The caps 176 and/or 178 may be provided to cover the applicator 124 and/or the blending tool 154. The caps 176, 178 may prevent damage or disfigurement to the applicator 124 and/or blending tool 154; reduce the likelihood of contacting and/or contaminating surfaces other than those intended to receive the personal care product 180; and/or help prevent moisture loss from the personal care product 180. In certain embodiments, the caps 176, 178 may be provided as temporary covers, which are intended to be removed and discarded by the consumer after purchase. Alternatively, the caps 176 and/or 178 may be reattachable such that they can be reused over the intended life of the personal care product 180 and/or package 100.

The personal care products suitable for use herein may be provided in a variety of product forms including brushable gels and creams, non-foaming liquids, mechanically pumpable liquids, non-aerosol gels, aerosol gels, aerosol foams, pastes, serums, and sprays.

Example I

A Multichromatic, Liquid Foundation is Prepared as Follows

| Ingredient | Wt % |
|---|---|
| Colored crosslinked gel network*1 | 40.00 |
| Dimethicone copolyol crosspolymer (KSG21) | 5.00 |
| Cyclomethicone (DC245) | 19.35 |
| Propylparabens | 0.10 |
| Ethylparabens | 0.20 |
| Water | 15.00 |
| Titanium dioxide | 8.25 |
| Iron oxides | 1.75 |
| Glycerin | 10.00 |
| Benzyl alcohol | 0.25 |
| Methylparabens | 0.10 |
| Ammonium polyacrylate (Darvan 821A*2 | 0.12 |
| Disodium EDTA | 0.10 |

*1Colored gel comprising 10% pigments (titanium dioxide and iron oxides) having a 60 micron average particle size, approximately 12% polymer, and 78% cyclomethicone fluid.
*2Supplied by Vanderbilt.

In a suitable vessel, the water, glycerine, disodium EDTA and benzyl alcohol are added and mixed using conventional technology until a clear water phase is achieved. When the water phase is clear add methylparabens and mix again until clear. Then add the ammonium polyacrylate, titanium dioxide and iron oxides and mix to disperse. Mix the resultant phase with a Silverson SL2T or similar equipment on high speed (8,000 rpm, standard head) to fully deagglomerate the pigments. In a separate vessel, add the KSG21, hydrophobic titanium dioxide and iron oxides, DC245 and the parabens. This mixture is milled using a Silverson on high speed until homogeneous. Next, the colored water phase and the colored, silicone phase are combined and milled using a Silverson on high speed until the water is fully incorporated and an emulsion is formed. Finally, a colored gel is then chosen so as to be significantly different in colour to the blend of titanium dioxide and iron oxides. This is then added and the product is mixed again using a Silverson on high speed. The resulting multichromatic, finished product is then incorporated into the appropriate package.

Example II

A Skin-Care Composition is Prepared as Follows

| Ingredient | Wt % |
|---|---|
| Phase A | |
| Water | QS (~20% total water) |
| Glycerin | 10.0000 |
| Allantoin | 0.1000 |
| Sodium Ascorbyl Phosphate | 0.10000 |
| *Vitis Vinifera* (Grapeseed) Extract | 0.02000 |
| Green Tea Extract | 0.1 |
| Propylene Glycol | 1.0000 |
| Butylene Glycol | 1.03950 |
| Benzyl Alcohol | 0.4000 |
| Matrixyl*1 | 3.0 |
| Glycolic Acid | 3.9900 |
| Triethanolamine | 1.0000 |
| Sodium Hydroxide | 1.1250 |
| Phase B | |
| Water | QS (~80% total water) |
| d-Panthenol | 0.5000 |
| Hydroxyethylcellulose | 1.00000 |
| Ultrez 21*2 | — |
| Sepigel 305*3 | — |
| Simulgel I-NS 100*4 | — |
| Simulgel EG*5 | — |
| Sepiplus 600*6 | — |
| AxCel CDG-PX*7 | 0.10000 |
| After Mixing Phase A into Phase B, add: | |
| Colorona Aborigne Amber*8 | 0.02000 |

*1Anti-aging peptide solution from Sederma, Inc., Edison, NJ.
*2Acrylates/C10-30 alkyl acrylate crosspolymer from Noveon Consumer Specialties, Cleveland, OH.
*3Polyacrylamide and C13-14 Isoparaffin and Laureth-7 from SEPPIC, Inc., Fairfield, NJ.
*4Hydroxyethyl acrylate/sodium acryloyldimethyl taurate copolymer and isohexadecane and polysorbate 60 from SEPPIC, Inc., Fairfield, NJ.
*5Sodium acrylate/sodium acryloyldimethyl taurate copolymer and isohexadecane and polysorbate 80 from SEPPIC, Inc., Fairfield, NJ.
*6Hydroxyethyl acrylate/sodium acryloyldimethyl taurate copolymer and isohexadecane and polysorbate 60 from SEPPIC, Inc., Fairfield, NJ.
*7Mixture of microfibrous cellulose, xanthan gum, and sodium carboxymethylcellulose from CP Kelco, San Diego, CA.
*8Mica coated with iron oxide, iron oxide black, and titanium dioxide from EMD Chemicals, Inc., Gibbstown, NJ.

Phase A materials are blended in a container. Phase B materials are blended in a separate container. Phase B is blended into Phase A. The platelet particulates are added after combining Phase A and Phase B.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package for applying a personal care product to the skin of a user, the package comprising:

a body for storing and dispensing the personal care product, the body having a first cross-sectional shape and being graspable by the user's hand; and an applicator joined to the body of the package, the applicator including a solid skin-contacting portion having a second cross-sectional shape and a surface pattern;

wherein each of the first cross-sectional shape and the second cross-sectional shape has a major dimension oriented along a first axis and a minor dimension oriented along a second axis, wherein the major dimensions are greater than the minor dimensions and wherein the second cross-sectional shape is an oval;

wherein the body is formed from a flexible, resilient material and wherein squeezing the body urges the personal care product out of the package; wherein the package further comprises a blending tool that is attached to the body and is located opposite of the applicator; wherein the blending tool is removably connected to a cap.

2. The package of claim 1, wherein the first axis of the body substantially aligns with the first axis of the skin-contacting portion.

3. The package of claim 1, wherein the surface pattern in the form of a plurality of discontinuous dots, discontinuous lines, discontinuous shapes, a continuous matrix, or a combination of these.

4. The package of claim 1, wherein the surface pattern includes surface features selected from the group consisting of apertures, raised portions, recessed portions, and combinations of these.

5. The package of claim 4, wherein the surface pattern includes apertures that extend through the skin-contacting portion and wherein the personal care product passes through the apertures when dispensed from the body of the package.

6. The package of claim 4, wherein the surface pattern includes raised portions and wherein the personal care product is applied only to the raised portions of the skin-contacting portion.

7. The package of claim 1, further comprising the personal care product.

8. The package of claim 7, wherein the personal care product comprises a liquid make up composition selected from the group consisting of a cosmetic primer and a cosmetic foundation.

9. The package of claim 1, wherein the skin-contacting portion of the applicator includes a rotatable roller.

10. The package of claim 9, wherein the personal care product is applied onto the skin by transferring the personal care product to the roller and rolling the rotatable roller over the skin.

11. The package of claim 1, wherein the body is openable and closable such that when the body is open, the personal care product is in liquid communication with the applicator.

12. The package of claim 11, wherein the body is formed from a rigid plastic material and the applicator is pivotable such that pivoting the applicator to a first position opens the body and pivoting the applicator to a second position closes the body.

13. The package of claim 1, wherein the skin-contacting portion of the applicator includes a first zone and a second zone and wherein the surface pattern in the first zone is different from the surface pattern in the second zone.

14. The package of claim 13, wherein the surface pattern in the first zone includes a first surface feature and the surface pattern in the second zone includes a second surface feature and wherein the surface features in the first and second zones differ by at least one of shape, type, or size.

15. The package of claim 1, wherein the first cross-sectional shape is symmetrical.

16. The package of claim 1, wherein the skin-contacting portion is designed to fit between a user's nose and upper lip.

17. The package of claim 1, wherein the package comprises an over-cap, the over-cap being removably attached to the body.

18. A package for applying a liquid personal care product, the package comprising:

a body for grasping with a user's hand, wherein the body has a first cross-sectional shape, and wherein the body further comprises an outlet for dispensing a liquid personal care product; and an applicator comprising a solid skin-contacting portion, wherein the skin-contacting portion has a second cross-sectional shape, wherein the skin-contacting portion is patterned, and wherein the applicator is in fluid communication with the outlet;

wherein each of the first cross-sectional shape and the second cross-sectional shape comprises a major dimension oriented along a first axis and a minor dimension oriented along a second axis, wherein the major dimensions are greater than the minor dimensions, wherein the first cross-sectional shape is oriented with the second cross-sectional shape such as the body is manipulated by a user's hand, the user is assured that the skin-contacting portion is oriented as intended on the skin;

wherein the second cross-sectional shape is an oval;

wherein the body is formed from a flexible, resilient material and wherein squeezing the body urges the personal care product out of the package; wherein the package further comprises a blending tool that is attached to the body and is located opposite of the applicator; wherein the blending tool is removably connected to a cap.

* * * * *